United States Patent [19]

Uji-Ie et al.

[11] 4,332,884

[45] Jun. 1, 1982

[54] PHOTO-SENSITIVE AND HEAT-SENSITIVE COMPOSITION AND RECORDING ELEMENT USING SAME

[75] Inventors: Koji Uji-Ie, Kawasaki; Masaakira Umehara; Kiyoshi Taniguchi, both of Yokohama; Makoto Kunikane, Chigasaki, all of Japan

[73] Assignee: Ricoh Co., Ltd., Tokyo, Japan

[21] Appl. No.: 203,164

[22] Filed: Nov. 3, 1980

[30] Foreign Application Priority Data

Nov. 14, 1979 [JP] Japan ..... 54-147562

[51] Int. Cl.[3] ..... G03C 1/52; G03C 1/727

[52] U.S. Cl. ..... 430/338; 430/337; 430/936; 430/341

[58] Field of Search ..... 430/338, 341, 340, 342–344, 430/936, 337

[56] References Cited

U.S. PATENT DOCUMENTS 3,390,996 7/1968 MacLachlan ..... 430/344
4,066,459 1/1978 Bachman et al. ..... 430/394
4,075,019 2/1978 DoMinh ..... 430/936
4,271,251 6/1981 Aotani et al. ..... 430/344

*Primary Examiner*—Won H. Louie, Jr.
*Attorney, Agent, or Firm*—Blanchard, Flynn, Thiel, Boutell & Tanis

[57] ABSTRACT

A photo-sensitive and heat-sensitive composition consisting essentially of (a) a photooxidant, (b) a color-generator generating color when oxidized, (c) an acid promoting said color generation, (d) a cobalt (III) complex, (e) a photoreductant, (f) a hydrogen donator and (g) a chelating agent consisting of a dioxime compound having the general formula:

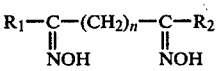

(where n is an integer of 0 to 3, and $R_1$ and $R_2$ can each represent an alkyl, aryl or aralkyl group), and a recording element using the same.

18 Claims, No Drawings

PHOTO-SENSITIVE AND HEAT-SENSITIVE COMPOSITION AND RECORDING ELEMENT USING SAME

BACKGROUND OF THE INVENTION

1. Field of the Invention

This invention relates to a photo-sensitive and heat-sensitive composition which is devised to be fixed when irradiated with visible light and heated, and to generate color when irradiated with ultraviolet rays to thereby produce a high quality image, and a recording element comprising a support and a layer of said composition superposed thereon.

2. Description of the Prior Art

A considerably large number of photo-sensitive compositions, photo-sensitive and heat-sensitive compositions and image-forming recording elements using said compositions have been widely utilized or proposed up to now. As typical examples there can be enumerated, for instance, diazo copying materials using alkali media as developers, photographic films using silver salts, etc. However, the above-mentioned photo-sensitive compositions and recording elements are defective in the fact that developers and fixers must be used in order to obtain an image.

As an attempt to eliminate the foregoing defect, public attention has been attracted to dry photochemical photo-sensitive compositions and recording elements capable of forming images only with light as described in Japanese Patent Publication Nos. 19161/1968, 40150/1970, 17855/1972, Japanese Laid Open Patent Application No. 12879/1972, etc. For instance, the photo-sensitive composition as described in Japanese Patent Publication No. 19161/1968 comprises (a) a photooxidant such as hexaarylbiimidazole, tetraarylhydrazine or the like, (b) a color-generator such as leuco-pigment, hydrazone or the like and (c) a binary system redox couple comprising an oxidant component such as quinone, ketone or the like and a reductant component such as alcohol, ester or the like or a one component system redox couple such as 1,4-bis(2-methoxyethyl)anthraquinone or the like. The said photo-sensitive composition generates color by means of light of specific wavelength, such as ultraviolet rays. The color generating reaction is performed by the action of a photooxidant and a color-generator, and the originally generated color is deactivated permanently, that is, fixed by light of a different wavelength, such as visible light. The fixing reaction is performed by the action of said redox couple. The photo-sensitive composition of this type, accordingly, can obtain both positive images and negative images by selection of the sequence of irradiation of ultraviolet rays and visible light, but is defective in that the fixing sensitivity (non-color-forming sensitivity) is still low.

Japanese Patent Publication Nos. 139722/1975, 139723/1975, 139724/1975, etc. each disclose an image-forming recording element comprising a support and a photo-sensitive and heat-sensitive layer superposed thereon. The photo-sensitive and heat-sensitive composition used herein is mainly composed of (a) a cobalt(III) complex and (b) a photoreductant such as quinone, diazonium salt, disulfide or the like. In the case of the composition of this sort an image is formed in such a manner that the photoreductant generates a reducing agent when irradiated with visible light, and this agent reduces and discolors the cobalt(III) complex when heated (at the same time the cobalt(III) complex generates a basic substance such as ammonia or the like). Moreover, Japanese Patent Publication No. 139724/1975 proposes to accelerate the reduction of the cobalt(III) complex as well as promote the developed color density by the addition of a chelating agent such as nitroso-arol, dithiooxyamide or the like. At any rate, the use of such a chelating agent-containing photo-sensitive and heat-sensitive composition, on the one hand, is advantageous in that a high sensitivity image can be obtained as compared with diazo copying materials, aided by the aid of the oxidation-reduction reaction between the cobalt(III) complex and the photoreductant. On the other hand this type of composition is defective in the following points, namely, (1) since the coloration of the composition is effected by the action of generated chelate (II) or (III) compounds there can be obtained only a negative image, and (2) the obtained image undergoes severe thermal fogging (in the heating step, the periphery of the exposed area also generates color) and the like.

SUMMARY OF THE INVENTION

The primary object of this invention is to provide a highly photo-sensitive and heat-sensitive composition which forms a high-contrast image and is capable of widely enhancing the generating (fixing) sensitivity of a basic substance such as ammonia or the like without deteriorating the color-forming sensitivity of the color-generating system comprising a photooxidant, a color-generator and an acid by further introducing a specific chelating agent into the generating system of a basic substance such as ammonia or the like, said chelating agent comprising a cobalt(III) complex and a photoreductant, and a recording element using said composition.

The secondary object of this invention is to provide a photo-sensitive and heat-sensitive composition which is capable of obtaining not only a positive image but also a negative image from one and the same original, and a recording element using said composition.

The third object of this invention is to provide a photo-sensitive and heat-sensitive composition which is capable of forming a clear-cut image free from thermal fog and a recording element using said composition.

In other words, the composition according to this invention is characterized by consisting essentially of (a) a photooxidant, (b) a color-generator generating color when oxidized, (c) an acid promoting said color generation, (d) a cobalt(III) complex, (e) a photoreductant, (f) a hydrogen donator and (g) a chelating agent consisting of a dioxime compound having the general formula:

$$R_1-\underset{\underset{NOH}{\|}}{C}-(CH_2)_n-\underset{\underset{NOH}{\|}}{C}-R_2$$

(where n is an integer of 0 to 3, and $R_1$ and $R_2$ can each represent an alkyl, aryl or aralkyl group), and a recording element using the said composition.

In the composition according to this invention, the aforesaid three components (a) (b) and (c) constitute the color-generating system and aforesaid four components (d), (e), (f) and (g) constitute the fixing system. However, since the composition per se is photo-sensitive as well as heat-sensitive in nature, it is generally utilized to prepare a mono-layer recording element comprising a support such as paper, plastic film or the like and a photo-sensitive and heat-sensitive layer which is formed by applying the composition onto the support so as to have a dry thickness of about 2–40 μm. Further, by the use of the composition of this invention there may be prepared a two-layer recording element having a fixing layer of about 1 to 20 μm-thick and a color-generating layer of about 1 to 20 μm-thick, by dividing the composition into two systems, i.e., a fixing system and a color-generating system, applying onto a support, the fixing system and the color-generating system in that order and then drying. According to a similar method of application, there may be prepared a three-layer recording element comprising an approximately 1 to 10 μm-thick binder intermediate layer which is positioned between the fixing layer and the color-generating layer mainly for the purpose of enhancing the color-forming sensitivity. In this case there can be employed a solvent and a binder in combination with the composition, that is, the color-generating system and/or fixing system, in order to facilitate the applying (coating) operation and improve the dispersion and adhesion of the respective elements used. At any rate, suitable quantities of the photooxidant and the acid in the color-generating system are about 0.1 to 10 moles and 1 to 10 moles per mole of the color-generator respectively. The suitable quantities of the cobalt(III) complex, the hydrogen donator and the chelating agent in the fixing system are about 0.1 to 10 moles, 0.5 to 10 moles and 0.01 to 10 moles per mole of the photoreductant, respectively. The suitable ratio of the color-generator to the photoreductant is about 1:1 to 20 (mole). The quantity of the binder is normally about 30 to 90% based on the weight of the composition or each layer.

Next, reference will be made to the respective elements used in this invention.

The photooxidant used in this invention is a compound operable to produce an oxidizing substance when irradiated by of ultraviolet rays and thereby oxidizes a color-generator (leuco-pigment) with said oxidizing substance for color generating purposes. Said compound comprises two types: one is a compound operating as an initiator and the other is a compound operating as acceptor. The initiator type photooxidants suitably used in this invention include hexaarylbiimidazoles and tetraarylhydrazines, and the acceptor type photooxidants suitably used in this invention include tetraacylhydrazines, diacylaminobenzotriazoles, benzothiazolediisulfides, triacylhydroxylamines, diacylaminotriazoles, alkylidene-2,5-cyclohexadiene-1-ones, a certain copolymer, diacylaminopyrazoles, bibenzotriazoles, and others given below. Typical examples of these compounds are enumerated as follows:

(A) Hexaarylbiimidazoles
2,2′-bis(p-methoxyphenyl)-4,4′,5,5′-tetraphenylbiimidazole,
2,2′-bis(p-cyanophenyl)-4,4′,5,5′-tetrakis(p-methoxyphenyl)biimidazole,
2,8′-bis(p-cyanophenyl)-4,4′,5,5′-tetrakis(p-methoxyphenyl)biimidazole,
2,2′-bis(3,4,5-trimethylphenyl)-4,4′,5,5′-tetrakis(p-methylthiophenyl)biimidazole,
2,2′-bis(o-methoxyphenyl)-4,4′,5,5′-tetraphenylbiimidazole,
2,2′-bis(2,4-dichlorophenyl)-4,4′,5,5′-tetrakis(p-methoxyphenyl)biimidazole,
2,2′-bis(o-bromophenyl)-4,4′,5,5′-tetraphenylbiimidazole,
2,2′-bis(2,4-dimethoxyphenyl)-4,4′,5,5′-tetraphenylbiimidazole,
2,2′-bis(o-chlorophenyl)-4,4′,5,5′-tetraphenylbiimidazole,
2,2′-bis(o-chlorophenyl)-4,4′,5,5′-tetrakis(m-methoxyphenyl)biimidazole,
2,2′-bis(o-chlorophenyl)-4,4′-bis(p-methoxyphenyl)-5,5′-diphenylbiimidazole, and
2,2′-bis(o-chloro-p-methoxyphenyl)-4,4′,5,5′-tetraphenylbiimidazole.

(B) Tetraarylhydrazines
tetraphenylhydrazine,
tetra-p-tolylhydrazine, and
tetrakis(p-methoxyphenyl)hydrazine.

(C) Tetraacylhydrazines
tetraacetylhydrazine,
tetraformylhydrazine, and
tetrabenzoylhydrazine.

(D) Diacylaminobenzotriazoles
1-diacetylaminobenzotriazole, and
1-dibenzoylamino-5-chlorobenzotriazole.

(E) Benzothiazole disulfides
bis(2-benzothiazolyl)disulfide, and
bis(6-methoxy-2-benzothiazolyl)disulfide.

(F) Triacylhydroxylamines
N,N,O-triacetylhydroxylamine,
N,N,O-tripropionylhydroxylamine,
N,N,O-tribenzoylhydroxylamine, and
N,N,O-tris(p-chlorobenzoyl)hydroxylamine.

(G) Diacylaminotriazoles
1-diacetylamino-3,5-diphenyl-1H-1,2,4-triazole,
1-dipropionylamino-3,5-diphenyl-1H-1,2,4-triazole, and
1-dibenzoylamino-4,5-diphenyl-1H-1,2,3-triazole.

(H) Alkylidene-2,5-cyclohexadiene-1-ones
2,6-dimethyl-4-(1,1,3,3-tetrafluoro-1,3-dichloroisopropylidene)-2,5-cyclohexadien-1-one.

(I) Selected polymers
Polymethacrylaldehyde.

(J) Diacylaminopyrazoles
1-diacetylaminopyrazole, and
1-dipropionylamino-4-chloropyrazole.

(K) Bibenzotriazoles
1,2′-bibenzotriazole,
5,5′-dichloro-1,1′-bibenzotriazole, and
5,5′-dimethyl-1,1′-bibenzotriazole.

As the other photooxidants, there can be enumerated halogen compounds.

(L) Halogen compounds
carbon tetraiodide (initiator type)
iodoform (the same as above)
carbon tetrabromide (acceptor type)
1,2,3,4-tetrachlorobenzene (the same as above)
1,2,3,4-tetrabromobutane (the same as above)
Hexachloroethane (the same as above)

Of the above mentioned photooxidants, the hexaarylbiimidazoles can be represented by the formula

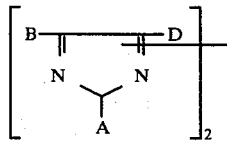

wherein A, B and D stand for aryl radicals. The B and D groups normally carry 0–3 substituents, the A groups 0–4 substituents. The aryl groups include one- and two-ring aryls, such as phenyl, biphenyl, naphthyl, pyridyl, furyl, thienyl and the like. The substituents may be halogen, cyano, lower hydrocarbyl (including alkyl, halo alkyl, cyanoalkyl, hydroxyalkyl, aryl and the like), lower alkoxy, aryloxy, lower alkylthio, arylthio, sulfo, alkylsulfonyl, nitro, lower alkylcarbonyl and the like. The alkyl groups are preferably of 1–6 carbon atoms, while aryl groups are preferably of 6–10 carbon atoms. Preferable hexaarylbiimidazoles include 2,2′,4,4′,5,5′-hexaphenylbiimidazole bearing chlorine, bromine, fluorine, $C_1$–$C_6$ alkoxy or $C_1$–$C_6$ alkyl group at the ortho-position of the 2- and 2′-phenyl rings, most preferably 2,2′-bis(o-chlorophenyl)-4,4′,5,5′-tetraphenylbiimidazole.

The color-generator is a substantially colorless compound which generates color upon undergoing the oxidizing action of an oxidizing substance coming from the photooxidant. When contained in the composition, it is naturally required to be stable against airing under normal storage conditions. Such exemplary color-generators are enumerated as follows:

(a) Aminotriarylmethanes bis(4-amino-2-butylphenyl)(p-dimethylaminophenyl)methane
bis(4-amino-2-chlorophenyl)(p-aminophenyl)methane
bis(4-amino-3-chlorophenyl)(o-chlorophenyl)methane
bis(4-amino-3-chlorophenyl)phenylmethane
bis(4-amino-3,5-diethylphenyl)(o-chlorophenyl)methane
bis(4-amino-3,5-diethylphenyl)(o-ethoxyphenyl)methane
bis(4-amino-3,5-diethylphenyl)(p-methoxyphenyl)methane
bis(4-amino-3,5-diethylphenyl)phenylmethane
bis(4-amino-3-ethylphenyl)(o-chlorophenyl)methane
bis(p-aminophenyl)(4-amino-m-tolyl)methane
bis(p-aminophenyl)(o-chlorophenyl)methane
bis(p-aminophenyl)(p-chlorophenyl)methane
bis(p-aminophenyl)(2,4-dichlorophenyl)methane
bis(p-aminophenyl)(2,5-dichlorophenyl)methane
bis(p-aminophenyl)(2,6-dichlorophenyl)methane
bis(p-aminophenyl)phenylmethane
bis(4-amino-o-tolyl)(p-chlorophenyl)methane
bis(4-amino-o-tolyl)(2,4-dichlorophenyl)methane
bis(p-anilinophenyl)(4-amino-m-tolyl)methane
bis(4-benzylamino-2-cyanophenyl)(p-aminophenyl)methane
bis(p-benzylethylaminophenyl)(p-chlorophenyl)methane
bis(p-benzylethylaminophenyl)(p-diethylaminophenyl)methane
bis(p-benzylethylaminophenyl)(p-dimethylaminophenyl)methane
bis(4-benzylethylamino-o-tolyl)(p-methoxyphenyl)methane
bis(p-benzylethylaminophenyl)-phenylmethane
bis(4-benzylethylamino-o-tolyl)(o-chlorophenyl)methane
bis(4-benzylethylamino-o-tolyl)(p-diethylaminophenyl)methane
bis(4-benzylethylamino-o-tolyl)(4-diethylamino-o-tolyl)methane
bis(4-benzylethylamino-o-tolyl)(p-dimethylaminophenyl)methane
bis[2-chloro-(2-diethylaminoethyl)ethylaminophenyl]-(o-chlorophenyl)methane
bis[p-bis(2-cyanoethyl)aminophenyl]phenylmethane
bis[p-(2-cyanoethyl)ethylamino-o-tolyl](p-dimethylaminophenyl)methane
bis[p-(2-cyanoethyl)methylaminophenyl](p-diethylaminophenyl)methane
bis(p-dibutylaminophenyl)[p-(2-cyanoethyl)methylaminophenyl]methane
bis(p-dibutylaminophenyl)(p-diethylaminophenyl)methane
bis(4-diethylamino-2-butoxyphenyl)(p-diethylaminophenyl)methane
bis(4-diethylamino-2-fluorophenyl)o-tolylmethane
bis(p-diethylamino)(p-aminophenyl)methane
bis(p-diethylaminophenyl)(4-anilino-1-naphthyl)methane
bis(p-diethylaminophenyl)(m-butoxyphenyl)methane
bis(p-diethylaminophenyl)(o-chlorophenyl)methane
bis(p-diethylaminophenyl)(p-cyanophenyl)methane
bis(p-diethylaminophenyl)(2,4-dichlorophenyl)methane
bis(p-diethylaminophenyl)(4-diethylamino-1-naphthyl)methane
bis(p-diethylaminophenyl)(p-dimethylaminophenyl)methane
bis(p-diethylaminophenyl)(4-ethylamino-1-naphthyl)methane
bis(p-diethylaminophenyl)2-naphthylmethane
bis(p-diethylaminophenyl)(p-nitrophenyl)methane
bis(p-diethylaminophenyl)2-pyridylmethane
bis(p-diethylamino-n-tolyl)(p-diethylaminophenyl)methane
bis(4-diethylamino-o-tolyl)(o-chlorophenyl)methane
bis(4-diethylamino-o-tolyl)(p-diethylaminophenyl)methane
bis(4-diethylamino-o-tolyl)(p-diphenylaminophenyl)methane
bis(4-diethylamino-o-tolyl)phenylmethane
bis(4-dimethylamino-2-bromophenyl)phenylmethane
bis(p-dimethylaminophenyl)(4-anilino-1-naphthyl)methane
bis(p-dimethylaminophenyl)(p-butylaminophenyl)methane
bis(p-dimethylaminophenyl)(p-sec. butylethylaminophenyl)methane
bis(p-dimethylaminophenyl)(p-chlorophenyl)methane
bis(p-dimethylaminophenyl)(p-diethylaminophenyl)methane
bis(p-dimethylaminophenyl)(4-dimethylamino-1-naphthyl)methane
bis(p-dimethylaminophenyl)(6-dimethylamino-m-tolyl)methane
bis(p-dimethylaminophenyl)(4-dimethylamino-o-tolyl)methane
bis(p-dimethylaminophenyl)(4-ethylamino-1-naphthyl)methane
bis(p-dimethylaminophenyl)(p-hexyloxyphenyl)methane
bis(p-dimethylaminophenyl)(p-methoxyphenyl)methane
bis(p-dimethylaminophenyl)(5-methyl-2-pyridyl)methane
bis(p-dimethylaminophenyl) 2-quinolylmethane
bis(p-dimethylaminophenyl) o-tolylmethane
bis(p-dimethylaminophenyl)(1,3,3-trimethyl-2-indolinylidenemethyl)methane
bis(4-dimethylamino-o-tolyl)(p-aminophenyl)methane
bis(4-dimethylamino-o-tolyl)(o-bromophenyl)methane bis(4-dimethylamino-o-tolyl)(o-cyanophenyl)methane
bis(4-dimethylamino-o-tolyl)(o-fluorophenyl)methane
bis(4-dimethylamino-o-tolyl) 1-naphthylmethane
bis(4-dimethylamino-o-tolyl)phenylmethane
bis(p-ethylaminophenyl)(o-chlorophenyl)methane
bis(4-ethylamino-m-tolyl)(o-methoxyphenyl)methane
bis(4-ethylamino-m-tolyl)(p-methoxyphenyl)methane
bis(4-ethylamino-m-tolyl)(p-dimethylaminophenyl)methane
bis(4-ethylamino-m-tolyl)(p-hydroxyphenyl)methane
bis[4-ethyl(2-hydroxyethyl)amino-m-tolyl](p-diethyl aminophenyl)methane
bis[p-(2-hydroxyethyl)aminophenyl](o-chlorophenyl)methane
bis[p-(bis(2-hydroxyethyl)aminophenyl)](4-diethylamino-o-tolyl)methane
bis[p-(2-methoxyethyl)aminophenyl]phenylmethane
bis(p-methylaminophenyl)(o-hydroxyphenyl)methane
bis(p-propylaminophenyl)(m-bromophenyl)methane
tris(4-amino-o-tolyl)methane
tris(4-anilino-o-tolyl)methane
tris(p-benzylaminophenyl)methane
tris[4-bis(2-cyanoethyl)amino-o-tolyl]methane
tris[p-(2-cyanoethyl)ethylaminophenyl]methane
tris(p-dibutylaminophenyl)methane
tris(p-di-n-butylaminophenyl)methane
tris(4-diethylamino-2-chlorophenyl)methane
tris(p-diethylaminophenyl)methane
tris(4-diethylamino-o-tolyl)methane
tris(p-dihexylamino-o-tolyl)methane
tris(4-dimethylamino-o-tolyl)methane
tris(p-hexylaminophenyl)methane
tris[p-bis(2-hydroxyethyl)aminophenyl]methane
tris(p-methylaminophenyl)methane
tris(p-dioctadecylaminophenyl)methane
tris(4-diethylamino-2-fluorophenyl)methane
tris(4-dimethylamino-2-fluorophenyl)methane
bis(2-bromo-4-diethylaminophenyl)phenylmethane
bis(2-butoxy-4-diethylaminophenyl)phenylmethane
bis(4-diethylamino-o-tolyl)(p-methoxyphenyl)methane
bis(4-diethylamino-2-methoxyphenyl)(p-nitrophenyl)methane
bis(4-diethylamino-1-naphthyl)(4-diethylamino-o-tolyl)methane
bis(4-diethylamino-o-tolyl)1-naphthylmethane
bis(4-diethylamino-o-tolyl)phenylmethane
tris(4-dimethylamino-2-chlorophenyl)methane
bis(4-dimethylamino-2,5-dimethylphenyl)phenylmethane
bis(4-dimethylamino-o-tolyl)(o-bromophenyl)methane
bis(4-ethylbenzylamino-o-tolyl)(p-methoxyphenyl)methane
tris(p-dioctylamino-o-tolyl)methane
bis(4-diethylamino-o-tolyl)-4-methoxy-1-naphthylmethane
bis(4-diethylamino-o-tolyl)-3,4,5-trimethoxyphenylmethane
bis(4-diethylamino-o-tolyl)-p-hydroxyphenylmethane
5-[bis(4-diethylamino-o-tolyl)methyl]-2,3-cresotic acid
4-[bis(4-diethylamino-o-tolyl)-methyl]-phenol
4-[bis(4-diethylamino-o-tolyl)-methyl]-acetanilide
4-[bis(4-diethylamino-o-tolyl)-methyl]-phenylacetate
4-[bis(4-diethylamino-o-tolyl)-methyl]-benzoic acid
4-[bis(4-diethylamino-o-tolyl)-methyl]-diphenyl sulfone
4-[bis(4-diethylamino-o-tolyl)-methyl]-phenylmethyl sulfone
4-[bis(4-diethylamino-o-tolyl)-methyl]-methylsulfonanilide
4-[bis(4-diethylamino-o-tolyl)-methyl]-p-tolylsulfonanilide
bis(4-diethylamino-o-tolyl)-p-nitrophenyl methane
bis(4-diethylamino-o-tolyl)(2-diethylamino-4-methyl-5-thiazolyl)methane
bis(4-diethylamino-o-tolyl)(2-diethylamino-5-methyl-6-benzoxazolyl)methane
bis(4-diethylamino-o-tolyl)(2-diethylamino-5-methyl-6-benzothiazolyl)methane
bis(4-diethylamino-o-tolyl)(1-ethyl-2-methyl-3-indolyl)methane
bis(4-diethylamino-o-tolyl)(1-benzyl-2-methyl-3-indolyl)methane
bis(4-diethylamino-o-tolyl)(1-ethyl-2-methyl-5-methoxyl-3-indolyl)methane
bis(1-o-xylyl-2-methyl-3-indolyl)(4-diethylamino-o-tolyl)methane
bis(4-diethylamino-o-tolyl)(1-ethyl-5-indolinyl)methane
bis(1-isobutyl-6-methyl-5-indololinyl)(4-diethylamino-o-tolyl)methane
nis(4-diethylamino-o-tolyl)(8-methyl-9-julolindinyl)methane
bis(4-diethylamino-2-acetamidophenyl)(4-diethylamino-o-tolyl)methane
4-[bis(4-diethylamino-o-tolyl)methyl]-N-ethylacetanilide
bis[4-(1-phenyl-2,3-dimethyl-5-pyrazolinyl)](4-diethylamino-o-tolyl)methane
bis(4-diethylamino-o-tolyl)(7-diethylamino-4-methyl-3-coumarinyl)methane
bis(4-diethylamino-o-tolyl)(4-acrylamidophenyl)methane
bis(4-diethylamino-o-tolyl)(p-benzylthiophenyl)methane
bis(4-diethylamino-o-tolyl)(4-isopropylthio-3-methylphenyl)methane
bis(4-diethylamino-o-tolyl)(4-chlorobenzylthiophenyl)methane
bis(4-diethylamino-o-tolyl)(2-furyl)methane
bis(4-diethylamino-o-tolyl)(3,4-methylenedioxyphenyl)methane
bis(4-diethylamino-o-tolyl)(3,4-dimethoxyphenyl)methane
bis(4-diethylamino-o-tolyl)(3-methyl-2-thienyl)methane
bis(4-diethylamino-o-tolyl)(2,4-dimethoxyphenyl)methane In addition to the above enumerated aminotriarylmethanes there can be employed leucatriphenylmethane dyes bearing CI numbers 42000B, 42005, 42010, 42025, 42030, 42035, 42036, 42040, 42500, 42505, 42510B, 42515, 42520, 42555B, 42556, 42563B, 42600, 42605, 42705, 42760, 42785, 43500.

(b) Aminoxanthenes 3-amino-6-dimethylamino-2-methyl-9-(o-chlorophenyl)xanthene
3-amino-6-dimethylamino-2-methyl-9-phenylxanthene
3-amino-6-dimethylamino-2-methylxanthene
3,6-bis(diethylamino)-9-(o-chlorophenyl)xanthene
3,6-bis(diethylamino)-9-hexylxanthene
3,6-bis(diethylamino)-9-(o-methoxycarbonylphenyl)xanthene
3,6-bis(diethylamino)-9-methylxanthene
3,6-bis(diethylamino)-9-phenylxanthene
3,6-bis(diethylamino)-9-o-tolylxanthene
3,6-bis(dimethylamino)-9-(o-chlorophenyl)xanthene
3,6-bis(dimethylamino)-9-ethylxanthene
3,6-bis(dimethylamino)-9-(o-methoxycarbonylphenyl)xanthene 3,6-bis(dimethylamino)-9-methylxanthene In addition to the above enumerated aminoxanthenes there can be employed leuco forms of xanthene dyes bearing CI Numbers 45000, 45005, 45010, 45015, 45050, 45070, 45090, 45095, 45100, 45105, 45150.

(c) Aminothioxanthenes 3,6-bis(diethylamino)-9-(o-ethoxycarbonylphenyl)thioxanthene
3,6-bis(dimethylamino)-9-(o-methoxycarbonylphenyl)-thioxanthene
3,6-bis(dimethylamino)thioxanthene
3,6-dianilino-9-(o-ethoxycarbonylphenyl)thioxanthene (d) Amino-9,10-dihydroacridines 3,6-bis(benzylamino)-9,10-dihydro-9-methylacridine
3,6-bis(diethylamino)-9-hexyl-9,10-dihydroacridine
3,6-bis(diethylamino)-9,10-dihydro-9-methylacridine
3,6-bis(diethylamino)-9,10-dihydro-9-phenylacridine
3,6-diamino-9-hexyl-9,10-dihydroacridine
3,6-diamino-9,10-dihydro-9-methylacridine
3,6-diamino-9,10-dihydro-9-phenylacridine
3,6-bis(dimethylamino)-9-hexyl-9,10-dihydroacridine
3,6-bis(dimethylamino)-9,10-dihydro-9-methylacridine.

In addition thereto there can also be enumerated the leuco forms of acridine dyes bearing CI numbers 46000, 46005B, 46010, 46015, 46020, 46025, 46030, 46035, 46040, 46055, 46060, 46065, 46070, 46075, 46080.

(e) Aminophenoxazines 3,7-bis(diethylamino)phenoxazine
9-dimethylamino-benzo[a]phenoxazine and leuco forms of phenoxazine dyes bearing CI numbers 51000, 51180, 51185, 51190, and 51195 (for instance, 5-benzylamino-9-diethylamino-benzo[a]phenoxadine)

(f) Aminophenothiazines 3,7-bis(benzylamino)phenothiazine and leuco forms of phenothiazine dyes bearing CI numbers 52000, 52010, 52015, 52020, 52025, 52030, 52035, 52050 (for instance, 3,7-bis(dimethylamino)-4-nitrophenothiazine, 3,7-bis[N-ethyl-N(m-sulfobenzyl)amino]phenothiazine, monosodium salt, 3,7-diaminophenothiazine)

(g) Aminodihydrophenazines 3,7-bis(benzylethylamino)-5,1-dihydro-5-phenylphenazine
3,7-bis(diethylamino)-5-hexyl-5,10-dihydrophenazine
3,7-bis(dihexylamino)-5,10-dihydrophenazine
3,7-bis(dimethylamino)-5-(p-chlorophenyl)-5,10-dihydrophenazine
3,7-diamino-5-(o-chlorophenyl)-5,10-dihydrophenazine
3,7-diamino-5,10-dihydrophenazine
3,7-diamino-5,10-dihydro-5-methylphenazine
3,7-diamino-5-hexyl-5,10-dihydrophenazine
3,7-bis(dimethylamino)-5,10-dihydrophenazine
3,7-bis(dimethylamino)-5,10-dihydro-5-phenylphenazine
3,7-bis(dimethylamino)-5,10-dihydro-5-methylphenazine In addition thereto there can be enumerated leuco forms of phenazine dyes bearing CI numbers 50035, 50040, 50045, 50200, 50205, 50206, 50210, 50216, 50220, 50225, 50235, 50240.

(h) Aminodiphenylmethanes 1,4-bis[bis-p(diethylaminophenyl)methyl]piperazine
bis(p-diethylaminophenyl)anilinomethane
bis(p-diethylaminophenyl)-1-benzotriazolylmethane
bis(p-diethylaminophenyl)-2-benzotriazolylmethane
bis(p-diethylaminophenyl)(p-chloroanilino)methane
bis(p-diethylaminophenyl)(2,4-dichloroanilino)methane
bis(p-diethylaminophenyl)(methylamino)methane
bis(p-diethylaminophenyl)(octadecylamino)methane
bis(p-dimethylaminophenyl)aminomethane
bis(p-dimethylaminophenyl)anilinomethane
1,1-bis(dimethylaminophenyl)ethane
1,1-bis(dimethylaminophenyl)heptane
bis(4-methylamino-m-tolyl)aminoethane.

(i) Leuco indoamines 4-amino-4'-dimethylaminodiphenylamine
p-(p-dimethylaminoanilino)phenol and leuco forms of indoamine and indophenol dyes bearing CI numbers 49400, 49405, 49410, 49700.

(j) Aminohydrocinnamic acids (cyanoethanes, leucomethines)

4-amino-α,β-dicyanohydrocinnamic acid, methyl ester
4-anilino-α,β-dicyanohydrocinnamic acid, methyl ester
4-(p-chloroanilino)-α,β-dicyanohydrocinnamic acid, methyl ester
α-cyano-4-dimethylaminohydrocinnamamide
α-cyano-4-dimethylaminohydrocinnamic acid, methyl ester
α,β-dicyano-4-diethylaminohydrocinnamic acid, methyl ester
α,β-dicyano-4-dimethylaminohydrocinnamamide
α,β-dicyano-4-dimethylaminohydrocinnamic acid, methyl ester
α,β-dicyano-4-dimethylaminohydrocinnamic acid
α,β-dicyano-4-dimethylaminohydrocinnamic acid, hexyl ester
α,β-dicyano-4-ethylaminohydrocinnamic acid, methyl ester
α,β-dicyano-4-hexylaminohydrocinnamic acid, methyl ester
α,β-dicyano-4-methylaminocinnamic acid, methyl ester
p-(2,2-dicyanoethyl)-N,N-dimethylaniline
4-methoxy-4'-(1,2,2-tricyanoethyl)azobenzene
4-(1,2,2-tricyanoethyl)azobenzene
p-(1,2,2-tricyanoethyl)-N,N-dimethylaniline and substituted hydrocinnamic acids, namely leuco-pigments comprising dyes bearing CI numbers 48000, 48001, and 48005.

(k) Hydrazines 1-(p-diethylaminophenyl)-2-(2-pyridyl)hydrazine
1-(p-dimethylaminophenyl)-2-(2-pyridyl)hydrazine
1-(3-methyl-2-benzothiazolyl)-2-(4-hydroxy-1-naphthyl)hydrazine
1-(2-naphthyl)-2-phenylhydrazine
1-p-nitrophenyl-2-phenylhydrazine
1-(1,3,3-trimethyl-2-indolinyl)-2-(3-phenylcarbamoyl-4-hydroxy-1-naphthyl)hydrazine (l) Leuco indigoid dyes The leuco forms of indigoid dyes having CI numbers 73000, 73015, 73025, 73030, 73035, 73040, 73045, 73050, 73055, 73060, 73065, 73070, 73085, 73090, 73110, 73300, 73305, 73310, 73315, 73320, 73325, 73335, 73340, 73345, 73350, 73360.

(m) Amino-2,3-dihydroanthraquinones 1,4-dianilino-2,3-dihydroanthraquinone
1,4-bis(ethylamino)-2,3-dihydroanthraquinone and leuco forms of dyes bearing CI numbers 61100, 61105, 61107, 61116, 61120, 61140, 61500, 61505, 61510, 61515, 61520, 61525, 61530, 61535, 61540, 61545, 61565, 61650 [for instance, 1-amino-4-methoxyanilino-2,3-dihydroanthraquinone, 1-p-(2-hydroxyethylamino)anilino-4-methylamino-2,3-dihydroanthraquinone].

(n) Phenethylanilines

N-(2-cyanoethyl)-p-phenethylaniline
N,N-diethyl-p-phenylethylaniline

N,N-dimethyl-p-[2-(1-naphthyl)ethyl]aniline
N,N-dimethyl-p-[2-(4-nitro-1-naphthyl)ethyl]aniline
N,N-dimethyl-p-phenethylaniline
N,N-dimethyl-p-[2-(4-methoxy-1-naphthyl)ethyl]aniline
p-(p-methoxyphenethyl)aniline
p-[2-(1-naphthyl)ethyl]aniline
p-(p-nitrophenethyl)aniline
p-phenethylaniline (B) Organic amines 4,4'-ethylenedianiline
diphenylamine
N,N-dimethylaniline
4,4'-methylenedianiline
triphenylamine
N-vinylcarbazole Acids are required as coloring assistants for promoting the color generation of the color-generator. As exemplary acids there can be enumerated organic or inorganic acids such as maleic acid, p-toluene sulfonic acid, hydrochloric acid, hydrobromic acid, nitric acid, phosphoric acid, acetic acid, oxalic acid, etc., and Lewis' acids such as zinc chloride, zinc bromide, ferric chloride, etc.

The cobalt(III) complexes used in the present invention, when heated, are subjected to reduction so as to produce basic substances such as ammonia, amine, etc., thereby accelerating the speed of fixing reaction, i.e., the fixing sensitivity. As typical examples of said complexes can be enumerated the following compounds:

(1) hexa-amine cobalt (III) perchlorate
(2) hexa-amine cobalt (III) acetate
(3) hexa-amine cobalt (III) thiocyanate
(4) hexa-amine cobalt (III) trifluoroacetate
(5) hexa-amine cobalt (III) benzylate
(6) chloropenta-amine cobalt (III) bromide
(7) chloropenta-amine cobalt (III) perchlorate
(8) bromopenta-amine cobalt (III) bromide
(9) bromopenta-amine cobalt (III) perchlorate
(10) aquopenta-amine cobalt (III) nitrate
(11) aquopenta-amine cobalt (III) perchlorate
(12) bis(ethylenediamine)di-amine cobalt (III) perchlorate
(13) bis(ethylenediamine)diazido cobalt (III) perchlorate
(14) bis(ethylenediamine)diacetate cobalt (III) chloride
(15) bis(ethylenediamine)diacetate cobalt (III) trifluoroacetate
(16) triethylenetetradichloro cobalt (III) acetate
(17) triethylenetetraamine dichloro cobalt (III) trifluoroacetate
(18) bis(methylamine)tetra-amine cobalt (III) hexafluorophosphate
(19) aquopenta(methylamine) cobalt (III) nitrate
(20) chloropenta(ethylamine) cobalt (III) chloride
(21) chloropenta(ethylamine) cobalt (III) perfluorobutanoate
(22) trinitrotris-amine cobalt (III)
(23) trinitrotris(methylamine) cobalt (III)
(24) tris(ethylenediamine) cobalt (III) acetate
(25) tris(ethylenediamine) cobalt (III) perchlorate
(26) tris(1,3-propanediamine) cobalt (III) trifluoroacetate
(27) bis(dimethylglyoxime)bispyridine cobalt (III) trichloroacetate
(28) N,N'-ethylenebis(salicylideneimine)bisamine cobalt (III) bromide
(29) N,N'-ethylenebis(salicylideneimine)bisamine cobalt (III) perchlorate
(30) bis(dimethylglyoxime)ethylaquo cobalt (III)
(31) μ-superoxodeca-amine dicobalt (III) perchlorate
(32) sodium dichloro ethylenediaminediaceto cobalt (III)
(33) penta-amine carbonate cobalt (III) nitrite
(34) penta-amine carbonate cobalt (III) perchlorate
(35) tris(glycinate) cobalt (III)
(36) trans[bis(ethylenediamine)chlorothiocyanato cobalt (III)] sulfite
(37) trans[bis(ethylenediamine)chlorothiocyanato cobalt (III)] perchlorate
(38) trans[bis(ethylenediamine)diazido cobalt (III)]chloride
(39) trans[bis(ethylenediamine)diazido cobalt (III)]thiocyanato
(40) cis[bis(ethylenediamine)amine diazido cobalt (III)]-trifluoroacetate
(41) tris(ethylenediamine) cobalt (III) chloride
(42) tris(ethylenediamine) cobalt (III) benzylate
(43) trans[bis(ethylenediamine)dichloro cobalt (III)]-chloride
(44) trans[bis(ethylenediamine)dichloro cobalt (III)]-perchlorate
(45) bis(ethylenediamine)dithiocyanato cobalt (III) fluoride
(46) bis(ethylenediamine)dithiocyanato cobalt (III) perfluorobenzoate
(47) triethylenetetramine dinitro cobalt (III) iodide
(48) triethylenetetramine dinitro cobalt (III) dichloroacetate
(49) tris(ethylenediamine) cobalt (III) 2-pyridylcarboxylate
(50) tris(ethylenediamine) cobalt (III) salicylate
(51) tris(2,2'-dipyridyl) cobalt (III) perchlorate
(52) bis(dimethylglyoxime)(chloropyridine) cobalt (III)
(53) bis(dimethylglyoxime)thiocyanatopyridine cobalt (III)

Further, the photoreductants suitably used in the present invention, when irradiated with visible light, produce reducing substances in the presence of hydrogen donators, which, when heated, are capable of instantaneously reducing the cobalt (III) complex compounds. As the typical examples of foregoing photoreductants, there can be enumerated quinone, disulfide, diazo anthrone, diazonium salt, diazo phenanthrone, aromatic azide, acyloin, aromatic ketone, aromatic carbazide, aromatic diazo sulfonate, etc. Above all, those capable of exhibiting strong absorption to the visible region are preferably used in the present invention.

The specific, exemplary disulfide, diazo anthrone, diazo phenanthrone, aromatic carbazide, aromatic azide, diazonium salt, and aromatic sulfonate compounds will be given below:

(1) 1-naphthyl disulfide
(2) β-naphthyl disulfide
(3) 9-anthryl disulfide
(4) cyclohexyl 2-naphthyl disulfide
(5) diphenylmethyl 2-naphthyl disulfide
(6) 2-dodecyl 1'-naphthyl disulfide
(7) thioctic acid
(8) 2,2'-bis(hydroxymethyl)diphenyl disulfide
(9) 10-diazonanthrone
(10) 2-methoxy-10-diazoanthrone
(11) 3-nitro-10-diazoanthrone
(12) 3,6-diethoxy-10-diazoanthrone
(13) 3-chloro-10-diazoanthrone

(14) 4-ethoxy-10-diazoanthrone
(15) 4-(1-hydroxyethyl)-10-diazoanthrone
(16) 2,7-diethyl-10-diazoanthrone
(17) 9-diazo-10-phenanthrone
(18) 3,6-dimethyl-9-diazo-10-phenanthrone
(19) 2,7-dimethyl-9-diazo-10-phenanthrone
(20) 4-azidobenzoic acid
(21) 4-nitrophenyl azide
(22) 4-dimethylaminophenyl azide
(23) 2,6-di-4-azidobenzylidene-4-methylcyclohexanone
(24) 2-azido-1-octylcarbamoyl-benzimidazole
(25) 2,5-bis(4-azidophenyl)-1,3,4-oxadiazole
(26) 1-azido-4-methoxynaphthalene
(27) 2-carbazido-1-naphthol
(28) benzophenone
(29) 2-nitrobenzophenone
(30) diaminobenzophenone
(31) phthalophenone
(32) phenyl(1-methoxybenzyl)ketone
(33) phenyl-1-(1-phenoxy)benzylketone
(34) phenyl-1-(2-chlorophenoxy)benzylketone
(35) phenyl-1-(4-chlorophenoxy)benzylketone
(36) phenyl-1-(2-bromophenoxy)benzylketone
(37) phenyl-1-(2-iodinephenoxy)benzylketone
(38) phenyl-1-(4-phenoxy)benzylketone
(39) phenyl-1-(4-benzoylphenoxy)benzylketone
(40) 4-(diamylamino)benzenediazonium tetrafluoroborate
(41) 2-methyl-4-diethylaminobenzenediazonium tetrafluoroborate
(42) 4-(oxazolidino)benzenediazonium tetrafluoroborate
(43) 4-(cyclohexylamino)benzenediazonium tetrafluoroborate
(44) 2-nitro-4-morpholinobenzenediazonium hexafluorophosphate
(45) 4-(9-carbazolyl)benzenediazonium hexafluorophosphate
(46) 4-(dihydroxyethylamino)-3-methylbenzenediazonium hexafluorophosphate
(47) 4-diethylaminobenzenediazonium hexachlorostannate
(48) 4-dimethylamino-3-methylbenzenediazonium hexachlorostannate
(49) 2-methyl-4-(N-methyl-N-hydroxypropylamino)-benzenediazonium hexachlorostannate
(50) 4-dimethylaminobenzenediazonium tetrachlorozincate
(51) 4-dimethylamino-3-ethoxybenzenediazonium chlorozincate
(52) 4-diethylaminobenzenediazonium tetrachlorozincate
(53) 4-diethylaminobenzenediazonium hexafluorophosphate
(54) 2-carboxy-4-dimethylaminobenzenediazonium hexafluorophosphate
(55) 3-(2-hydroxyethoxy)-4-pyrrolidinobenzenediazonium hexafluorophosphate
(56) 4-methoxybenzenediazonium hexafluorophosphate
(57) 2,5-diethoxy-4-acetamidobenzenediazonium hexafluorophosphate
(58) 4-methylamino-3-ethoxy-6-chlorobenzenediazonium hexafluorophosphate
(59) 3-methoxy-4-diethylaminobenzenediazonium hexafluorophosphate
(60) di(1-naphthyl)acyloin
(61) di(2-naphthyl)acyloin
(62) benzoin
(63) benzoin acetate
(64) benzoin methylether
(65) benzoin phenylether
(66) benzoin 2-bromophenylether
(67) benzoin 4-chlorophenylether
(68) benzoin 4-phenoxyphenyl ether
(69) benzoin 4-benzoylphenyl ether
(70) benzoin 2-iodinephenyl ether
(71) benzoin 2-chlorophenyl ether
(72) 2-phenylbenzoin
(73) 2-(1-naphthol)benzoin
(74) 2-n-butylbenzoin
(75) 2-hydroxymethyl benzoin
(76) 2-(2-cyanoethyl)benzoin
(77) 2-(5-pentynyl)benzoin
(78) potassium 4-(N-ethyl-N-hydroxyethylamino)-benzenediazosulfonate
(79) sodium 4-(diethylamino)benzenediazosulfonate
(80) potassium 2-chloro-4-morpholinobenzenediazosulfonate
(81) tetramethylammonium 3-methoxy-4-piperidinobenzenediazosulfonate In addition to the above mentioned substances, those obtained by subjecting the under mentioned amino compounds to diazotization may also be employed effectively as diazonium salts in the present invention. As the counter ions therefor there may be enumerated $Cl^-$, $ZnCl^-$, $SO_4^{2-}$, $BF_4^-$, $CF_3COO^-$, etc.

p-(p-tolylthio)aniline
2,4,5-trimethoxyaniline
5-amino-2-diethylamino-p-anisic acid, methyl ester
4-(p-tolylthio)o-ansidine
4-(4-amino-3-butylphenyl)morpholine
4-(4-amino-2,5-diethoxyphenyl)morpholine
4-(4-amino-2,5-dibutoxyphenyl)morpholine
4-(p-aminophenyl)morpholine
4-amino-1-naphthol
4-amino-7-methoxy-3-methyl-1-naphthol
4-amino-3-methyl-1-naphthol
$N^2,N^2$-dimethyl-1,2-naphthalenediamine
N,N-diethyl-1,4-naphthalenediamine
2-methyl-$N^1$-phenyl-1,4-naphthalenediamine
4-amino-2,6-dimethoxyphenol
$N^1,N^1$-diethyl-4-methyl-m-phenylenediamine
4-methoxy-$N^3,N^3$-dimethyl-m-phenylenediamine
N,N-diethyl-o-phenylenediamine
$N^1,N^1$-diethyl-4-methyl-o-phenylenediamine
N-methyl-N-phenyl-o-phenylenediamine
p-phenylenediamine
2-chloro-5-methoxy-$N^1,N^1$-dimethyl-p-phenylenediamine
$N^1$-cyclohexyl-2-methoxy-p-phenylenediamine
2,5-butoxy-N,N-diethyl-p-phenylenediamine
2,5-diethoxy-N,N-dimethyl-p-phenylenediamine
N,N-diethyl-p-phenylenediamine
2,5-dimethoxy-N-phenyl-p-phenylenediamine
N,N-dimethyl-p-phenylenediamine
N-(2-hydroxyethyl)-N-ethyl-p-phenylenediamine
N-(p-methoxyphenyl)p-phenylenediamine
N-phenyl-p-phenylenediamine
2-phenyl-$N^4,N^4$-dimethyl-p-phenylenediamine
1-(p-aminophenyl)piperidine
1-(p-aminophenyl)pyrrolidine
$N^2,N^2$-dimethyltoluene-2,5-diamine
4-amino-2,6-xylenol.

As previously stated, quinones can be effectively used as photoreductants. The quinones preferably used in the present invention include o- or p-benzoquinone, o- or p-naphthoquinone, phenanthrenequinone and anthraquinone. These quinones can be divided into the external hydrogen source type quinones which produce reducing agents by drawing their hydrogen sources (active hydrogen atoms) out of different compounds (hydrogen donators) and the internal hydrogen source type quinones, which include hydrogen sources of their own. The internal hydrogen source type quinones per se can exhibit a photoreducing property with ease but with little efficiency. Therefore, it is preferable that they should be used in combination with the hydrogen donators.

As the concrete examples of the aforesaid external hydrogen source type quinones there can be enumerated the following substances:

(1) 2,5-dimethyl-1,4-benzoquinone
(2) 2,6-dimethyl-1,4-benzoquinone
(3) duroquinone
(4) 2-(1-formyl-1-methylethyl)-5-methyl-1,4-benzoquinone
(5) 2-methyl-1,4-benzoquinone
(6) 2-phenyl-1,4-benzoquinone
(7) 2,5-dimethyl-6-(1-formylethyl)-1,4-benzoquinone
(8) 2-(2-cyclohexanonyl)-3,6-dimethyl-1,4-benzoquinone
(9) 1,4-naphthoquinone
(10) 2-methyl-1,4-naphthoquinone
(11) 2,3-dimethyl-1,4-naphthoquinone
(12) 2,3-dichloro-1,4-naphthoquinone
(13) 2-thiomethyl-1,4-naphthoquinone
(14) 2-(1-formyl-2-propyl)-1,4-naphthoquinone
(15) 2-(2-benzoylethyl)-1,4-naphthoquinone
(16) 9,10-phenanthrenequinone
(17) 2-tert-butyl-9,10-anthraquinone
(18) 2-methyl-1,4-anthraquinone
(19) 2-methyl-9,10-anthraquinone
(20) 1,8-pyrenequinone
(21) 1,6-pyrenequinone On the other hand, as concrete examples of the aforesaid internal hydrogen source type quinones there can be enumerated the following substances:

(1) 5,8-dihydro-1,4-naphthoquinone
(2) 5,8-dihydro-2,5,8-trimethyl-1,4-naphthoquinone
(3) 2,5-bis(dimethylamino)-1,4-benzoquinone
(4) 2,5-dimethyl-3,6-bis(dimethylamino)-1,4-benzoquinone
(5) 2,5-dimethyl-3,6-bispyrrolidino-1,4-benzoquinone
(6) 2-ethoxy-5-methyl-1,4-benzoquinone
(7) 2,6-dimethoxy-1,4-benzoquinone
(8) 2,5-dimethoxy-1,4-benzoquinone
(9) 2,6-diethoxy-1,4-benzoquinone
(10) 2,5-diethoxy-1,4-benzoquinone
(11) 2,5-bis(2-methoxyethoxy)-1,4-benzoquinone
(12) 2,5-bis(β-phenoxyethoxy)-1,4-benzoquinone
(13) 2,5-diphenethoxy-1,4-benzoquinone
(14) 2,5-di-n-propoxy-1,4-benzoquinone
(15) 2,5-di-isopropoxy-1,4-benzoquinone
(16) 2,5-di-n-butoxy-1,4-benzoquinone
(17) 2,5-di-sec-butoxy-1,4-benzoquinone
(18) 1,1'-bis(5-methyl-1,4-benzoquinone-2-yl)-diethyl ether
(19) 2-methyl-5-morpholinomethyl-1,4-benzoquinone
(20) 2,3,5-trimethyl-6-morpholinomethyl-1,4-benzoquinone
(21) 2,5-bis(morpholinomethyl)-1,4-benzoquinone
(22) 2-hydroxymethyl-3,5,6-trimethyl-1,4-benzoquinone
(23) 2-(1-hydroxyethyl)-5-methyl-1,4-benzoquinone
(24) 2-(1-hydroxy-n-propyl)-5-methyl-1,4-benzoquinone
(25) 2-(1-hydroxy-2-methyl-n-propyl)-5-methyl-1,4-benzoquinone
(26) 2-(1,1-dimethyl-2-hydroxyethyl)-5-methyl-1,4-benzoquinone
(27) 2-(1-acetoxyethyl)-5-methyl-1,4-benzoquinone
(28) 2-(1-methoxyethyl)-5-methyl-1,4-benzoquinone
(29) 2- (2-hydroxyethyl)-3,5,6-trimethyl-1,4-benzoquinone
(30) 2-ethoxy-5-phenyl-1,4-benzoquinone
(31) 2-i-propoxy-5-phenyl-1,4-benzoquinone
(32) 1,4-dihydro-1,4-dimethyl-9,10-anthraquinone
(33) 2-dimethylamino-1,4-naphthoquinone
(34) 2-methoxy-1,4-naphthoquinone
(35) 2-benzyloxy-1,4-naphthoquinone
(36) 2-methoxy-3-chloro-1,4-naphthoquinone
(37) 2,3-dimethoxy-1,4-naphthoquinone
(38) 2,3-diethoxy-1,4-naphthoquinone
(39) 2-ethoxy-1,4-naphthoquinone
(40) 2-phenethoxy-1,4-naphthoquinone
(41) 2-(2-methoxyethoxy)-1,4-naphthoquinone
(42) 2-(2-ethoxyethoxy)-1,4-naphthoquinone
(43) 2-(2-phenoxy)ethoxy-1,4-naphthoquinone
(44) 2-ethoxy-5-methoxy-1,4-naphthoquinone
(45) 2-ethoxy-6-methoxy-1,4-naphthoquinone
(46) 2-ethoxy-7-methoxy-1,4-naphthoquinone
(47) 2-n-propoxy-1,4-naphthoquinone
(48) 2-(3-hydroxypropoxy)-1,4-naphthoquinone
(49) 2-isopropoxy-1,4-naphthoquinone
(50) 7-methoxy-2-isopropoxy-1,4-naphthoquinone
(51) 2-n-butoxy-1,4-naphthoquinone
(52) 2-sec-butoxy-1,4-naphthoquinone
(53) 2-n-pentoxy-1,4-naphthoquinone
(54) 2-n-hexoxy-1,4-naphthoquinone
(55) 2-n-heptoxy-1,4-naphthoquinone
(56) 2-acetoxymethyl-3-methyl-1,4-naphthoquinone
(57) 2-methoxymethyl-3-methyl-1,4-naphthoquinone
(58) 2-(β-acetoxyethyl)-1,4-naphthoquinone
(59) 2-N,N-bis(cyanomethyl)aminomethyl-3-methyl-1,4-naphthoquinone
(60) 2-methyl-3-morpholinomethyl-1,4-naphthoquinone
(61) 2-hydroxymethyl-1,4-naphthoquinone
(62) 2-hydroxymethyl-3-methyl-1,4-naphthoquinone
(63) 2-(1-hydroxyethyl)-1,4-naphthoquinone
(64) 2-(2-hydroxyethyl)-1,4-naphthoquinone
(65) 2-(1,1-dimethyl-2-hydroxyethyl)-1,4-naphthoquinone
(66) 2-bromo-3-isopropoxy-1,4-naphthoquinone
(67) 2-ethoxy-3-methyl-1,4-naphthoquinone
(68) 2-chloro-3-piperidino-1,4-naphthoquinone
(69) 2-morpholino-1,4-naphthoquinone
(70) 2,3-dipiperidino-1,4-naphthoquinone
(71) 2-dibenzylamino-3-chloro-1,4-naphthoquinone
(72) 2-methyloxycarbonylmethoxy-1,4-naphthoquinone
(73) 2-(N-ethyl-N-benzylamino)-3-chloro-1,4-naphthoquinone
(74) 2-morpholino-3-chloro-1,4-naphthoquinone
(75) 2-pyrrolidino-3-chloro-1,4-naphthoquinone
(76) 2-diethylamino-3-chloro-1,4-naphthoquinone
(77) 2-diethylamino-1,4-naphthoquinone
(78) 2-piperidino-1,4-naphthoquinone
(79) 2-pyrrolidino-1,4-naphthoquinone
(80) 2-(2-hexyloxy)-1,4-naphthoquinone
(81) 2-neo-pentyloxy-1,4-naphthoquinone
(82) 2-(2-n-pentyloxy)-1,4-naphthoquinone
(83) 2-(3-methyl-n-butoxy)-1,4-naphthoquinone
(84) 2-(6-hydroxy-n-hexoxy)-1,4-naphthoquinone

(85) 2-ethoxy-3-chloro-1,4-naphthoquinone
(86) 2-di(phenyl)methoxy-1,4-naphthoquinone
(87) 2-(2-hydroxyethoxy)-3-chloro-1,4-naphthoquinone
(88) 2-methyl-3-(1-hydroxymethyl)ethyl-1,4-naphthoquinone
(89) 2-azetidino-3-chloro-1,4-naphthoquinone
(90) 2-(2-hydroxyethyl)-3-bromo-1,4-naphthoquinone
(91) 2,3-dimorpholino-1,4-naphthoquinone
(92) 2-ethylamino-3-piperidino-1,4-naphthoquinone
(93) 2-ethoxymethyl-1,4-naphthoquinone
(94) 2-phenoxymethyl-1,4-naphthoquinone In addition, 2H-benzimidazoles may be used as photoreductants, which, when irradiated with active radiant rays, produce reducing agents, dihydrobenzimidazoles, in the presence of unstable hydrogen atoms.

As the typical examples of 2H-benzimidazoles there can be enumerated the following substances:

(1) 2,2-dimethyl-2H-benzimidazole
(2) 2,2-diethyl-2H-benzimidazole
(3) 2,2-di-n-hexyl-2H-benzimidazole
(4) spiro(2H-benzimidazole-2,1'-cyclohexane)
(5) dispiro (2H-benzimidazole-2,1'-cyclohexan-4,2'-2H-benzimidazole)
(6) 2,2-benzyl-2H-benzimidazole
(7) 2,2-diphenyl-2H-benzimidazole
(8) 2,2-dimethyl-4-n-butyl-2H-benzimidazole
(9) 2,2-diphenyl-5-n-hexyl-2H-benzimidazole
(10) 2'-methyl spiro(2H-benzimidazole-2,1'-cyclohexane)
(11) 3'-methyl spiro(2H-benzimidazole-2,1'-cyclohexane)
(12) 4'-methyl spiro(2H-benzimidazole-2,1'-cyclohexane)
(13) 2',6'-dimethyl spiro(2H-benzimidazole-2,1'-cyclohexane)
(14) 5-methyl spiro(2H-benzimidazole-2,1'-cyclohexane)
(15) 5,6-dimethyl spiro(2H-benzimidazole-2,1'-cyclohexane)
(16) 5,5''-dimethyl dispiro(2H-benzimidazole-2,1'-cyclohexane)4',2''-2H-benzimidazole)
(17) 5,6,5'',6''-tetramethyl spiro(2H-benzimidazole-2,1'-cyclohexane-4',2''-2H-benzimidazole-2,1'-cyclohexane 4',2''-2H-benzimidazole)
(18) 4-bromo-2,2-dimethyl-2H-benzimidazole
(19) 5-iodine-2,2-dimethyl-2H-benzimidazole
(20) 5-chloro spiro(2H-benzimidazole-2,1'-cyclohexane)
(21) 4-chloro spiro(2H-benzimidazole-2,1'-cyclohexane)
(22) 2,2-diethyl-4-trichloromethyl-2H-benzimidazole
(23) 2,2-diphenyl-4-trifluoromethyl-2H-benzimidazole
(24) 2',3',4',5',6'-pentachloro spiro(2H-benzimidazole-2,1'-cyclohexane)
(25) 5-trifluoromethyl spiro(2H-benzimidazole-2,1'-cyclohexane)
(26) 2,2-dibenzyl-4-methoxy-2H-benzimidazole
(27) 2,2-diethyl-4-isopropoxy-2H-benzimidazole
(28) 2,2-diethyl-5-ethoxy-2H-benzimidazole
(29) 5-methoxy spiro(2H-benzimidazole-2,1'-cyclohexane)
(30) 4-ethoxy spiro(2H-benzimidazole-2,1'-cyclohexane)
(31) 5-isopropoxy spiro(2H-benzimidazole-2,1'-cyclohexane)
(32) 2'-methoxy spiro(2H-benzimidazole-2,1'-cyclohexane)
(33) 3'-neopentoxy spiro(2H-benzimidazole-2,1'-cyclohexane)
(34) 4,4'-dimethoxy dispiro(2H-benzimidazole-2,1'-cyclohexane-4',2''-2H-benzimidazole)
(35) 5,5''-diisopropoxy-2'-methoxy dispiro(2H-benzimidazole-2,1'-cyclohexane-4',2''-2H-benzimidazole)
(36) 2,2-dimethyl-4-amino-2H-benzimidazole
(37) 2,2-dimethyl-4-(N,N-dimethylamino)-2H-benzimidazole
(38) 2,2-dimethyl-5-(N-phenylamino)-2H-benzimidazole
(39) 2,2-dimethyl-5-(N-tolylamino)-2H-benzimidazole
(40) 4-(N,N-diphenylamino)spiro(2H-benzimidazole-2,1'-cyclohexane)
(41) 4-(N-phenylamino)spiro(2H-benzimidazole-2,1'-cyclohexane)
(42) 2'-morpholino spiro(2H-benzimidazole-2,1'-cyclohexane)
(43) 2,2-diphenyl-4-piperidino-2H-benzimidazole
(44) 2,2-diphenyl-5-methylazo-2H-benzimidazole
(45) 2'-methylazo spiro(2H-benzimidazole-2,1'-cyclohexane)
(46) 2,2-dimethyl-5-styryl-2H-benzimidazole
(47) 2,2-dimethyl-4-vinyl-2H-benzimidazole
(48) 5-vinyl spiro(2H-benzimidazole-2,1'-cyclohexane)
(49) 2,2-diphenyl-5-nitro-2H-benzimidazole
(50) 5-carbomethoxy spiro(2H-benzimidazole-2,1'-cyclohexane)

Also, 1,3-diazabicyclo[3,1,0]hexy-3-ene compounds can be used as photoreductants which, when exposed to active radiant rays and heat, are capable of producing the precursory substances of reducing agents and the reducing agents per se continuously. The exemplary 1,3-diazabicyclo[3,1,0]hexy-3-ene compounds can be defined as those represented by the formula

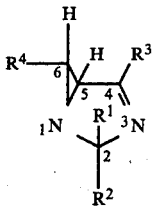

[wherein $R^1$ and $R^2$ are selected from hydrogen, alkyl (including cycloalkyl), aralkyl, alkaryl and aryl substituents; or $R^1$ and $R^2$ couple to form alkylene substituent, preferably 5 or 6 rings; $R^3$ is aryl radical or electron attractive radical such as cyano radical, carboxyl radical, nitro radical or carbonyl-containing radical; and $R^4$ is aryl or alkaryl radical]

The exemplary 1,3-diazabicyclo[3,1,0]hexy-3-ene forms of photoreductants are enumerated as follows:

(1) 4,6-diphenyl-1,3-diazabicyclo[3,1,0]hexy-3-ene
(2) 4-phenyl-6-(4-nitrophenyl)-1,3-diazabicyclo[3,1,0]hexy-3-ene
(3) 2,4,6-triphenyl-1,3-diazabicyclo[3,1,0]hexy-3-ene
(4) 2,4-diphenyl-6-(4-nitrophenyl)-1,3-diazabicyclo[3,1,0]hexy-3-ene
(5) 2,2-dicyclopropyl-4-phenyl-6-(4-nitrophenyl)-1,3-diazabicyclo[3,1,0]hexy-3-ene
(6) 2,6-diphenyl-4-cyano-1,3-diazabicyclo[3,1,0]hexy-3-ene
(7) 2-(1-naphthyl)-4,6-di(chlorophenyl)-1,3-diazabicyclo[3,1,0]hexy-3-ene
(8) 2-methyl-4-phenyl-6-(4-nitrophenyl)-1,3-diazabicyclo[3,1,0]hexy-3-ene (9) 2-n-propyl-4-phenyl-6-(4-nitrophenyl)-1,3-diazabicyclo[3,1,0]hexy-3-ene
(10) 2-isopropyl-4-phenyl-6-(4-nitrophenyl)-1,3-diazabicyclo[3,1,0]hexy-3-ene
(11) 2,2-dimethyl-4,6-diphenyl-1,3-diazabicyclo[3,1,0]hexy-3-ene
(12) 2,2-dimethyl-4-phenyl-6-(4-nitrophenyl)-1,3-diazabicyclo[3,1,0]hexy-3-ene
(13) 2,2-dimethyl-4-(4-nitrophenyl)-6-phenyl-1,3-diazabicyclo[3,1,0]hexy-3-ene
(14) 2,2-dimethyl-4-phenyl-6-(4-chlorophenyl)-1,3-diazabicyclo[3,1,0]hexy-3-ene
(15) 2-methyl-2-ethyl-4-phenyl-6-(4-nitrophenyl)-1,3-diazabicyclo[3,1,0]hexy-3-ene
(16) 2-methyl-2-n-propyl-4-phenyl-6-(4-nitrophenyl)-1,3-diazabicyclo[3,1,0]hexy-3-ene
(17) 2-methyl-2-t-butyl-4-phenyl-6-(4-nitrophenyl)-1,3-diazabicyclo[3,1,0]hexy-3-ene
(18) 2,4-diphenyl-2-methyl-6-(4-nitrophenyl)-1,3-diazabicyclo[3,1,0]hexy-3-ene
(19) 2,2-dimethyl-4-phenyl-6-(4-nitrophenyl)-1,3-diazabicyclo[3,1,0]hexy-3-ene
(20) 2,2-diethyl-4-phenyl-6-(3-nitrophenyl)-1,3-diazabicyclo[3,1,0]hexy-3-ene
(21) 2,2-di-n-hexyl-4,6-diphenyl-1,3-diazabicyclo[3,1,0]hexy-3-ene
(22) spiro{cyclopentane-1,2'[4'-phenyl-6'-(4-nitrophenyl)-1,3-diazabicyclo[3,1,0]hexy-3-ene]}
(23) spiro{cyclohexane-1,2'-[4'-phenyl-6'-(4-nitrophenyl)-1,3-diazabicyclo[3,1,0]hexy-3-ene]}
(24) spiro{cycloheptane-1,2'-[4'-phenyl-6'-(4-nitrophenyl)-1,3-diazabicyclo[3,1,0]hexy-3-ene]}
(25) spiro{cyclooctane-1,2'-[4'-phenyl-6'-(4-nitrophenyl)-1,3-diazabicyclo[3,1,0]hexy-3-ene]}
(26) spiro{1-methylcyclohexane-2,2'-[4'-phenyl-6'-(4-nitrophenyl)-1,3-diazabicyclo[3,1,0]hexy-3-ene]}
(27) spiro{1-methylcyclohexane-4,2'-[4'-phenyl-6'-(4-nitro-phenyl)-1,3-diazabicyclo[3,1,0]hexy-3-ene]}
(28) 2-(4-ethoxycarbonylphenyl)-4,6-diphenyl-1,3-diazabicyclo[3,1,0]hexy-3-ene
(29) 2,4-diphenyl-6-(benzoyloxyphenyl)-1,3-diazabicyclo[3,1,0]hexy-3-ene
(30) 2,6-di(1-naphthyl)-4-nitro-1,3-diazabicyclo[3,1,0]hexy-3-ene
(31) 2,6-di(4-nitrophenyl)-4-phenyl-1,3-diazabicyclo[3,1,0]hexy-3-ene
(32) 2,4-diphenyl-6-(3-nitrophenyl)-1,3-diazabicyclo[3,1,0]hexy-3-ene
(33) 2,6-diphenyl-4-(4-nitrophenyl)-1,3-diazabicyclo[3,1,0]hexy-3-ene
(34) 2-(4-tolyl)-4-phenyl-6-(4-nitrophenyl)-1,3-diazabicyclo[3,1,0]hexy-3-ene
(35) 2,6-di(4-tolyl)-4-phenyl-1,3-diazabicyclo[3,1,0]hexy-3-ene
(36) 2,4,6-tri(2-aminophenyl)-1,3-diazabicyclo[3,1,0]hexy-3-ene
(37) 2-(4-diethylaminophenyl)-4,6-diphenyl-1,3-diazabicyclo[3,1,0]hexy-3-ene
(38) 2,4-diphenyl-6-(4-morpholinophenyl)-1,3-diazabicyclo[3,1,0]hexy-3-ene
(39) 2-benzyl-4-nitro-6-phenyl-1,3-diazabicyclo[3,1,0]hexy-3-ene
(40) 2,4-diphenyl-4-nitro-6-phenyl-1,3-diazabicyclo[3,1,0]hexy-3-ene
(41) 2,4-diphenyl-6-(4-nitrophenyl)-1,3-diazabicyclo[3,1,0]hexy-3-ene
(42) 1-azonia-4,6-diphenyl-1-methyl-3-azabicyclo[3,1,0]hexy-3-ene.tetrafluoroborate
(43) 1-azonia-4,6-diphenyl-1,2,2-trimethyl-3-azabicyclo[3,1,0]hexy-3-ene.hexafluoroborate
(44) 1-azonia-4-phenyl-6-(4-nitrophenyl)-1,2,2-trimethyl-3-azabicyclo[3,1,0]hexy-3-ene.tetrafluoroborate
(45) 1-azonia-4-nitro-2,6-diphenyl-3-azabicyclo[3,1,0]hexy-3-ene.chloride
(46) 4,6-diphenyl-1,3-diazabicyclo[3,1,0]hexy-3-ene-1-oxide
(47) 2,2-dimethyl-6-(4-nitrophenyl)-4-phenyl-1,3-diazabicyclo[3,1,0]hexy-3-ene-1-oxide
(48) spiro{cyclopentane-1,2'-[4'-phenyl-6'-(4-nitrophenyl)-1',3'-diazabicyclo[3,1,0]hexy-3-ene-1-oxide]}
(49) spiro{1-methylcyclohexane-4,2'-[2',4',6'-triphenyl-1',3'-diazabicyclo[3,1,0]hexy-3-ene-1-oxide]}
(50) spiro{1-cycloheptane-1,2'-[2'-2'-dicyclopropyl-4'-6'-di(4-nitrophenyl)-1',3'-diazabicyclo[3,1,0]hexy-3-ene oxide]}

The hydrogen donators suitably used in the present invention, when exposed to light, supply active hydrogen atoms to photo-reductants for converting the latter into reducing substances. The exemplary examples thereof are as follows:

(1) poly(ethylene glycol)
(2) phenyl-1,2-ethanediol
(3) nitrilotriacetonitrile
(4) triethylnitrilotriacetate
(5) poly(vinyl butyral)
(6) poly(vinyl acetal)
(7) 1,4-benzenedimethanol
(8) methyl cellulose
(9) cellulose acetate butyrate
(10) 2,2-bis-(hydroxymethyl)-propionic acid
(11) 1,3-bis-(hydroxymethyl)-urea
(12) 4-nitrobenzyl alcohol
(13) 4-methoxybenzyl alcohol
(14) 2,4-dimethoxybenzyl alcohol
(15) 3,4-dichlorophenylglycol
(16) N-(hydroxymethyl)-benzamide
(17) N-(hydroxymethyl)-phthalimide
(18) 5-(hydroxymethyl)-uracil hemihydrate
(19) nitrilotriacetic acid
(20) 2,2',2''-triethylnitrilotripropionate
(21) 2,2',2''-nitrilotriacetophenone
(22) poly(vinyl acetate)
(23) poly(vinyl alcohol)
(24) ethyl cellulose
(25) carboxymethyl cellulose
(26) poly(vinyl formal)
(27) triethanolamine triacetate
(28) triethanolamine tripropionate
(29) triethanolamine tributyrate
(30) triethanolamine trivalerate The hydrogen donators suitably used in the present invention actually perform plural functions. For instance, the polymers of the above enumerated hydrogen donators also function as binders, and especially substances such as polyethylene glycol and alcohol, which while enhancing the fluidity of each element of the composition also function as color generating assistants.

The chelating agent used in this invention, which consists of the dioxime compound having the aforesaid general formula, is a substance which is capable of forming a bidenate chelate in combination with cobalt (II) and (III) and, as usual, promoting the reduction of cobalt (III) complex, but is not a substance which is usable as one component of the color-generating system for the purpose of forming a chelate exhibiting a highly developed color density. Accordingly, the chelating agent used in this invention is distinguished as to the latter point from conventional nitroso-arol and dithiooxyamide. In other words, the dioxime chelating agent according to this invention is a substance which is incorporated in the amplifying mechanism of the fixing system for promoting its fixing sensitivity. In this connection, it goes without saying that this chelating agent does not function so as to impede the color generating effect to be achieved by the color-generating system, but rather contributes to the suppression of coloration of the background area by forming a chelating compound exhibiting an extremely low developed color density in the visible region.

As exemplary chelating agents functioning as above there can be enumerated the following:

(1) glyoxime
(2) dimethylglyoxime
(3) benzyldioxime
(4) diethylglyoxime
(5) acetylacetonedioxime
(6) cyclohexane-1,2-dionedioxime
(7) 2-furyldioxime
(8) hexane-2,5-dionedioxime
(9) cyclopentane-1,2-dionedioxime
(10) heptane-2,6-dionedioxime The composition (color-developing system and/or fixing system) according to the present invention can be used with binders and solvents in addition to the foregoing components. The binders suitably used in the present invention include a wide variety of natural or synthetic polymers. It is preferable to selectively use from among them linear film-forming polymers, such as gelatin, celluloses, such as ethylcellulose, butylcellulose, cellulose acetate, cellulose triacetate, cellulose butylate, etc., vinyl polymers, such as polyvinyl acetate and polyvinylidene chloride, polyvinylacetals, such as polyvinylbutyral, poly(vinylchloride-vinylacetate), polystyrene, polybutadiene, polyvinylpyrrolidone, polymers or copolymers of esters of acrylic acid or methacrylic acid or both, and polyesters, such as poly(ethylene glycol-isophthalic acid-cyclohexylenebismethanol), poly(p-cyclohexanedicarbonic acid-2,2,4,4-tetramethylcyclobutane-1,3-diol). The condensate of epichlorohydrin and bisphenol is also usefully employed as a binder. In this connection, it should be noted that these binders can also be utilized for the formation of an intermediate layer.

The solvents used in the present invention include amides such as formamide, dimethylformamide, dimethylacetoamide, hexaneamide, etc., alcohols such as methanol, ethanol, 1-propanol, 2-propanol, butanol, ethylene glycol, polyethylene glycol, etc., esters such as ethyl acetate, ethyl benzoate, etc.; aromatic compounds such as benzene, o-dichlorobenzene, toluene, etc.; ketones such as acetone, methylethyl ketone, 3-pentanone, etc.; chlorinated hydrocarbons such as methylene chloride, chloroform, 1,1,2-trichloroethane, 1,1,2,2-tetrachloroethane, 1,1,2-trichloroethylene, etc.; dimethylsulfoxide; pyridine; tetrahydrofuran; dioxane; dicyanocyclobutane; 1-methyl-2-oxohexamethyleneimine, etc. In addition, water may be used if circumstances require.

Next, the image-forming method utilizing the composition according to this invention will be explained with reference to the instance of a mono-layer recording element as aforesaid.

First, reference will be made to the formation of a positive image. When the surface layer of said recording element is irradiated imagewise with visible light, the photoreductant, such as quinone, present in the exposed area of said surface layer absorbs this visible light and draws the hydrogen from the coexisting hydrogen donator, thereby forming hydroquinone, i.e., a reducing agent. Next, when the surface layer is heated to a temperature of about 80° to 150° C., cobalt (III) complex is reduced, thereby producing a basic substance such as $NH_3$ or the like in a chain reaction. This basic substance immediately functions to neutralize the acid present in the exposed area or trap the photooxidant such as hexaarylbiimidazole or the like present in the exposed area for inactivation or fixing. The chelating agent according to this invention can thus enhance the fixing sensitivity of the fixing system greatly as aforesaid. When the overall surface layer under such conditions is irradiated with ultraviolet rays, in the image area which has not been exposed to visible light, the hexaarylbiimidazole, for example, produces an imidazole radical which operates to oxidize the color generator, for instance, leuco-pigment in cooperation with the action of the acid present in the image area and thus leads to color generation. In this connection, the basic substance generated in a chain reaction manner in the above image forming method acts also upon the color-forming system (that is, the photooxidant, color generator and acid) so as to prevent the color generator from being oxidized.

The formation of a negative image, on the other hand, may be achieved by replacing the visible light used at the time of imagewise exposure in the aforesaid positive image forming method with ultraviolet rays, then irradiating the overall surface with visible light prior to heating treatment, and thereafter heating the same.

This invention, wherein the dioxime chelating agent is employed, makes it possible to form an image superior in fixing sensitivity and contrast, that is, an image being low in the background area density in both positive and negative image formation. The reason for these effects may be considered as follows. The main factors contributing to the background area density are the color of the Co (II) or (III) chelate compound produced when the photo-reduction reaction takes place and the color of the photoreductant (for instance yellow in case the photoreductant is 9,10-phenanthrenequinone). However, this invention can elude the undesirable results caused by said factors because this invention can produce a chelate compound exhibiting an extremely low developed color density. In this connection, it is to be noted that the decomposition and decoloration of the photoreductant can be attained by leaving it under a fluorescent light after image formation is completed.

The following examples are included for a further understanding of this invention.

DESCRIPTION OF THE PREFERRED EMBODIMENTS

EXAMPLES 1 TO 5

| | |
|---|---|
| acetone-isopropanol (volume ratio 9:1) mixed solvent | 10 ml |
| cellulose acetate butyrate | 1 g |
| 2,2'-bis(0-chlorophenyl)-4,4',5,5'-tetraphenylbiimidazole | 132 mg |
| bis(4-diethylamino-0-tolyl)-4-diethylaminophenylmethane | 50 mg |
| p-toluenesulfonic acid | 20 mg |
| polyethylene glycol | 0.5 g |
| 9,10-phenanthrenequinone | 30 mg |
| dimethylglyoxime | 120 mg |

-continued

| | |
|---|---|
| Co (III) complex (which see Table-1) | 1 m mole |

A mixed solution having the above composition was applied onto a 100 μm-thick polyethylene terephthalate film by means of a 4 mil doctor blade. The thus coated film was dried at 50° C. for 20 minutes to thereby form a 13 μm-thick photo-sensitive and heat-sensitive layer.

The thus obtained mono-layer recording element was subjected to a 20 second imagewise exposure with visible light having a spectral energy distribution of 400–500 nm and an intensity of 400 μW/cm$^2$, was thermally treated for 30 seconds on a stainless plate heated to 90° C., and thereafter was subjected to 2 minutes of overall irradiation with ultraviolet rays having an intensity of 150 μW/cm$^2$, whereby a superior positive-positive cyan image was produced. The observed results are set forth below in Table-1.

TABLE-1

| Example | CO(III) complex | Image area density | Background area density |
|---|---|---|---|
| 1 | hexaamine cobalt(III) trifluoroacetate | 1.0 | 0.4 |
| 2 | bis(ethylenediamine)diamine cobalt(III) perchlorate | 1.1 | 0.4 |
| 3 | bis(ethylenediamine)diacetate cobalt(III) trifluoroacetate | 0.8 | 0.3 |
| 4 | tris(ethylenediamine) cobalt(III) acetate | 1.0 | 0.3 |
| 5 | tris(1,3-propandiamine) cobalt(III) trifluoroacetate | 1.2 | 0.3 |

EXAMPLES 6 TO 15

| | |
|---|---|
| acetone-isopropanol (volume ratio 9:1) mixed solvent | 10 ml |
| polyvinyl butyral | 1 g |
| hexaamine cobalt(III) trifluoroacetate | 500 mg |
| dimethylglyoxime | 120 mg |
| photoreductant (see Table-2) | proper quantity |

A mixed solution having the above composition was applied onto a 100 μm-thick polyethylene terephthalate film by means of a 2 mil doctor blade. The thus coated film was air-dried, thereby forming a 6 μm-thick fixing layer. Next, a mixed solution having the following composition was applied onto said fixing layer by means of a 4 mil doctor blade and a 23 μm spacer and was air-dried to thereby form a 8 μm-thick color generating layer.

| | |
|---|---|
| acetone | 10 ml |
| cellulose acetate butyrate | 1 g |
| 2,2'-bis(0-chlorophenyl)-4,4',5,5'-tetraphenylbiimidazole | 132 mg |
| bis(4-diethylamino-0-tolyl)-4-diethylaminophenylmethane | 50 mg |
| p-toluenesulfonic acid | 40 mg |
| polyethylene glycol | 0.5 g |

The same image forming method as disclosed in Example 1 was applied repeatedly to the thus prepared double-layered recording element, thereby obtaining a positive-positive cyan image. The observed results are set forth below in Table-2.

TABLE-2

| Example | Photoreductant | Quantity added (m mole) | Image area density | Background area density |
|---|---|---|---|---|
| 6 | 9,10-phenanthrenequinone | 0.3 | 1.2 | 0.4 |
| 7 | diphenylmethyl 2-naphthyldisulfide | 4.0 | 1.0 | 0.5 |
| 8 | p-aminobenzene diazonium sulfate | 1.0 | 1.2 | 0.3 |
| 9 | 10-diazoanthrone | 5.0 | 1.0 | 0.2 |
| 10 | 2-nitrobenzophenone | 1.5 | 1.2 | 0.6 |
| 11 | phenyl-1-(1-phenoxy) benzylketone | 5.0 | 1.0 | 0.3 |
| 12 | benzoinphenyl ether | 6.0 | 1.0 | 0.2 |
| 13 | 2-isopropoxy-1,4-naphthoquinone | 5.0 | 1.0 | 0.2 |
| 14 | 2,2-diphenyl-2H-benziimidazole | 7.0 | 1.0 | 0.4 |
| 15 | 4,6-diphenyl-1,3-diazabicyclo [3,1,0]hexy-ene | 8.0 | 1.2 | 0.3 |

EXAMPLES 16 TO 20

| | |
|---|---|
| acetone-isopropanol (volume ratio 9:1) mixed solvent | 10 ml |
| polyvinyl butyral | 1 g |
| hexaamine cobalt(III) trifluoroacetate | 500 mg |
| dimethylglyoxime | 120 mg |
| 9,10-phenanthrenequinone | 60 mg |

A mixed solution having the above composition was applied onto a 100 μm-thick polyethylene terephthalate film by means of a 2 mil doctor blade and the same was air-dried to thereby form a 6 μm-thick fixing layer. Subsequently, a 10 wt.% aqueous solution of polyvinyl alcohol was applied onto said layer by means of a 2 mil doctor blade and a 23μ spacer and then the same was dried at 50° C. for 20 minutes to thereby form a 4 μm-thick intermediate layer thereon. Then, a mixed solution having the following composition was applied onto said layer by means of a 3 mil doctor blade and a 23 μm spacer and the same was air-dried to form a 6 μm-thick color generating layer.

| | |
|---|---|
| acetone | 10 ml |
| cellulose acetate butyrate | 1 g |
| 2,2'-bis(0-chlorophenyl)-4,4',5,5'-tetraphenylbiimidazole | 132 mg |
| p-toluene sulfonic acid (see Table-3) | proper quantity (see Table-3) |
| color generator (leuco-pigment) (see Table-3) | 0.1 m mole |
| polyethylene glycol | 0.5 g |

The obtained three-layer recording material was subjected to a 1 minute's imagewise exposure with an ultraviolet ray having an intensity of 150 μW/cm$^2$, successively was subjected to a 20 seconds' overall irradiation with visible light having a spectral energy distribution of 400 to 500 nm and an intensity of 400 μW/cm$^2$ and further was thermally treated for 20 seconds on a stainless plate heated to 120° C., whereby a satisfactory negative-positive image was formed, the background area of which was light yellow. The observed results are set forth below in Table-3.

TABLE-3

| Example | Color generator (leuco-pigment) | P-toluene sulfonic acid | Color tone |
|---|---|---|---|
| 16 | bis(4-diethylamino-0-tolyl)-4-diethylaminophenyl methane | 30 mg | blue |
| 17 | tris(p-hydroxyphenyl) methane | 30 mg | red |
| 18 | 3,6-bis(diethylamino)-9-(0-ethoxycarbonylphenyl)-xanthene zinc chloride double salt | 0 | red |
| 19 | 9,10-dihydro-3,6-bis (diethylamino)-9-phenyl-acridine zinc chloride double salt | 0 | red |
| 20 | phenothiazine | 35 mg | bluish green |

EXAMPLES 21 TO 26

| | |
|---|---|
| acetone-isopropanol (volume ratio 9:1) mixed solvent | 10 ml |
| polyvinyl butyral | 1 g |
| hexaamine cobalt(III) trifluoroacetate | 500 mg |
| dimethylglyoxime | 120 mg |
| 9,10-phenanthrenequinone | 60 mg |

A mixed solution having the above composition was applied onto a 100 μm-thick polyethylene terephthalate film by means of a 2 mil doctor blade and the same was air-dried to thereby form a 6 μm-thick fixing layer. Subsequently a 10 wt.% aqueous solution of polyvinyl alcohol was applied onto said layer by means of a 2 mil doctor blade and a 23 μm spacer and then the same was dried at 50° C. for 20 minutes to thereby form a 4 μm-thick intermediate layer. Still further, a mixed solution having the following composition was applied onto said layer by means of a 4 mil doctor blade and a 23 μm spacer and the same was air-dried to thereby form a 8 μm-thick color generating layer.

| | |
|---|---|
| acetone-isopropanol (volume ratio 9:1) | 10 ml |
| polyvinyl butyral | 1 g |
| bis(4-diethylamino-0-tolyl)-4-diethylaminophenylmethane | 50 mg |
| p-toluene sulfonic acid | 30 mg |
| polyethylene glycol | 0.5 g |
| photooxidant (see Table-4) | proper quantity (see Table-4) |

The obtained three-layer recording element was subjected to a 10 seconds of imagewise exposure with the same visible light source as employed in Example 1, then was thermally treated on an iron plate heated to 90° C. for 10 seconds, and successively was subjected to a 2 minutes' overall irradiation with ultraviolet rays, whereby a satisfactory positive-positive image was formed. The observed results are set forth below in Table-4.

TABLE-4

| Example | Photooxidant | Quantity added | Image area density | Background area density |
|---|---|---|---|---|
| 21 | 2,2'-bis(0-chlorophenyl)-4,4',5,5'-tetraphenylbiimidazole | 0.2 | 1.8 | 0.3 |
| 22 | 1-diacetylamino-benzotriazole | 1.0 | 1.2 | 0.3 |

TABLE-4-continued

| Example | Photooxidant | Quantity added | Image area density | Background area density |
|---|---|---|---|---|
| 23 | carbon tetrabromide | 2.0 | 1.0 | 0.3 |
| 24 | 2,6-dimethyl-4-(1,1,3,3-tetrafluoro-1,3-dichloroiso-propylidene)-2,5-cyclohexadiene | 5.0 | 1.0 | 0.3 |
| 25 | tetraacetylhydrazine | 0.4 | 1.4 | 0.3 |
| 26 | N,N,O-triacetyl-hydroxylamine | 1.0 | 1.0 | 0.3 |

EXAMPLES 27 TO 30

A three-layer recording element was prepared according to the exact same procedure as Example 21 with the exception that various dioxime chelating agents as enumerated in Table-5 were employed in place of the dimethylglyoxime employed in Example 21. The observed results are set forth below in Table 5.

TABLE-5

| Example | Dioxime chelating agent | Quantity added (mg) | Image area density (cyan) | Background area density |
|---|---|---|---|---|
| 27 | benzyldioxime | 250 | 1.8 | 0.2 |
| 28 | 2-furyldioxime | 150 | 1.8 | 0.3 |
| 29 | acetylacetonedioxime | 60 | 1.0 | 0.4 |
| 30 | cyclohexane-1,2-dionedioxime | 100 | 1.5 | 0.3 |

EXAMPLE 31

A two-layer recording element was prepared according to the exact same procedure as Example 16 with the exception that the intermediate layer was removed. By using this recording element there was obtained a positive-positive cyan image having an image area density 1.4 and a background area density 0.3.

EXAMPLE 32

A three-layer recording element was prepared according to the exact same procedure as Example 16 with the exception that a 10% aqueous solution of acetone was employed in place of the 10 wt.% aqueous solution of polyvinyl alcohol in the formation of the intermediate layer. By using this recording element there was obtained a positive-positive cyan image having an image area density 1.7 and a background area density 0.4.

What is claimed is:

1. A photo-sensitive and heat-sensitive composition consisting essentially of a photooxidant which produces an oxidizing substance when irradiated by ultraviolet radiation, a color-generator capable of being oxidized by said oxidizing substance to generate a visible color, an acid for promoting said color generation, a hydrogen donator, a photoreductant which when irradiated by visible light produces a reducing substance in the presence of said hydrogen donator, a cobalt (III) complex which when heated is reduced by said reducing substance so as to produce ammonia or an amine, and a chelating agent having the formula:

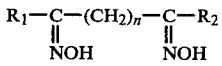

wherein n is an integer of 0 to 3, and $R_1$ and $R_2$ are alkyl, aryl or aralkyl.

2. A composition according to claim 1 wherein the quantities of said photo-oxidant and said acid are about 0.1 to 10 moles and about 1 to 10 moles, respectively, per mole of said color-generator; the quantities of said cobalt (III) complex, said hydrogen donator and said chelating agent are about 0.1 to 10 moles, about 0.5 to 10 moles and about 0.01 to 10 moles, respectively, per mole of said photoreductant; and the molar ratio of said color-generator to said photoreductant is about 1:1 to 20.

3. A composition according to claim 1 further including a binder.

4. A composition according to claim 3 wherein the quantity of said binder is about 30 to 90% of the weight of the composition.

5. A recording element comprising a support and a photo-sensitive and heat-sensitive layer superposed on said support, said layer consisting essentially of a photooxidant which produces an oxidizing substance when irradiated by ultraviolet radiation, a color-generator capable of being oxidized by said oxidizing substance to generate a visible color, an acid for promoting the color generation, a hydrogen donator, a photoreductant which when irradiated by visible light produces a reducing substance in the presence of said hydrogen donator, a cobalt (III) complex which when heated is reduced by said reducing substance so as to produce ammonia or an amine, and a chelating agent having the formula:

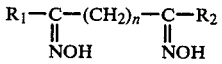

wherein n is an integer of 0 to 3, and $R_1$ and $R_2$ are alkyl, aryl or aralkyl.

6. A recording element according to claim 5 wherein the quantities of said photooxidant and said acid are about 0.1 to 10 moles and about 1 to 10 moles, respectively, per mole of said color-generator; the quantities of said cobalt (III) complex, said hydrogen donator and said chelating agent are about 0.1 to 10 moles, about 0.5 to 10 moles and about 0.01 to 10 moles, respectively, per mole of said photoreductant; and the molar ratio of said color-generator to said photoreductant is about 1:1 to 20.

7. A recording element according to claim 5 wherein said layer further includes a binder.

8. A recording element according to claim 5 wherein the thickness of said layer is about 2 to 40 μm.

9. A recording element comprising, in successive layers, a support; a fixing layer consisting essentially of a hydrogen donator, a photoreductant which when irradiated by visible light produces a reducing substance in the presence of said hydrogen donator, a cobalt (III) complex which when heated is reduced by said reducing substance so as to produce ammonia or an amine, and a chelating agent having the formula:

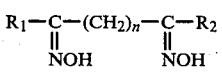

wherein n is an integer of 0 to 3, and $R_1$ and $R_2$ are alkyl, aryl or aralkyl; and a color generating layer consisting essentially of a photooxidant which produces an oxidizing substance when irradiated by ultraviolet radiation, a color generator capable of being oxidized by said oxidizing substance to generate a visible color and an acid for promoting the color generation.

10. A recording element according to claim 9 wherein the quantities of said photooxidant and said acid contained in said color generating layer are about 0.1 to 10 moles and about 1 to 10 moles, respectively, per mole of said color generator; the quantities of said cobalt (III) complex, said hydrogen donator and said chelating agent contained in said fixing layer are about 0.1 to 10 moles, about 0.5 to 10 moles and about 0.01 to 10 moles, respectively, per mole of said photoreductant; and the molar ratio of said color generator to said photoreductant is about 1:1 to 20.

11. A recording element according to claim 9 wherein the fixing and color generating layers further include a binder, respectively.

12. A recording element according to claim 11 wherein the quantity of said binder is about 30 to 90% of the weight of each layer.

13. A recording element according to claim 9 wherein the thickness of said fixing layer is about 1 to 20μ, and the thickness of said color generating layer is about 1 to 20μ.

14. A recording element comprising, in successive layers, a support; a fixing layer consisting essentially of a hydrogen donator, a photoreductant which when irradiated by visible light produces a reducing substance in the presence of said hydrogen donator, a cobalt (III) complex which when heated is reduced by said reducing substance so as to produce ammonia or an amine, and a chelating agent having the formula:

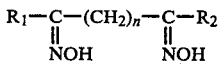

wherein n is an integer of 0 to 3, and $R_1$ and $R_2$ are alkyl, aryl, or aralkyl; an intermediate layer consisting of a binder; and a color generating layer consisting essentially of a photooxidant which produces an oxidizing substance when irradiated by ultraviolet radiation, a color-generator capable of being oxidized by said oxidizing substance to generate a visible color and an acid for promoting the color generation.

15. A recording element according to claim 14 wherein the quantities of said photooxidant and said acid contained in said color generating layer are about 0.1 to 10 moles and about 1 to 10 moles, respectively, per mole of said color-generator; the quantities of said cobalt (III) complex, said hydrogen donator and said chelating agent contained in said fixing layer are about 0.1 to 10 moles, about 0.5 to 10 moles and about 0.01 to 10 moles, respectively, per mole of said photoreductant; and the molar ratio of said color generator to said photoreductant is about 1:1 to 20.

16. A recording element according to claim 14 wherein the fixing and color generating layers further include a binder, respectively.

17. A recording element according to claim 16 wherein the quantity of said binder is about 30 to 90% of the weight of each layer.

18. A recording element according to claim 14 wherein the thickness of the fixing layer is about 1 to 20μ, the thickness of the intermediate layer is about 1 to 10μ, and the thickness of the color generating layer is about 1 to 20μ.

* * * * *